US006964266B2

(12) United States Patent
Brenk et al.

(10) Patent No.: US 6,964,266 B2
(45) Date of Patent: Nov. 15, 2005

(54) 3/2 DIRECTIONAL-CONTROL VALVE

(75) Inventors: Achim Brenk, Kaempfelbach-Bilfingen (DE); Wolfgang Klenk, Loechgau (DE); Uwe Gordon, Kemmern (DE); Manfred Mack, Altheim (DE)

(73) Assignee: Robert Bosch GmbH, Stuttgart (DE)

( * ) Notice: Subject to any disclaimer, the term of this patent is extended or adjusted under 35 U.S.C. 154(b) by 108 days.

(21) Appl. No.: 10/239,642

(22) PCT Filed: Jan. 22, 2002

(86) PCT No.: PCT/DE02/00186

§ 371 (c)(1),
(2), (4) Date: Feb. 10, 2003

(87) PCT Pub. No.: WO02/059475

PCT Pub. Date: Aug. 1, 2002

(65) Prior Publication Data

US 2004/0069274 A1 Apr. 15, 2004

(30) Foreign Application Priority Data

Jan. 24, 2001 (DE) ..... 101 03 089

(51) Int. Cl.[7] ..... F02M 37/04
(52) U.S. Cl. ..... 123/514; 123/510
(58) Field of Search ..... 123/510, 514, 123/499, 490, 456, 467, 446

(56) References Cited

U.S. PATENT DOCUMENTS 5,638,791 A * 6/1997 Tsuzuki et al. ..... 123/467
5,727,525 A * 3/1998 Tsuzuki ..... 123/447
5,771,865 A * 6/1998 Ishida ..... 123/467
5,890,653 A * 4/1999 Kelly ..... 239/5
6,109,542 A * 8/2000 Morris et al. ..... 239/88
6,129,332 A * 10/2000 Dusterhoft ..... 251/28
6,460,515 B2 * 10/2002 Askew ..... 123/506
6,634,336 B1 * 10/2003 Kropp ..... 123/467
6,634,339 B2 * 10/2003 He et al. ..... 123/496
6,644,282 B2 * 11/2003 Schwarz ..... 123/467
6,655,355 B2 * 12/2003 Kropp et al. ..... 123/467

FOREIGN PATENT DOCUMENTS

| | | |
|---|---|---|
| DE | 844376 C | 7/1952 |
| DE | 19724637 | 12/1998 |
| DE | 19907931 A | 9/2000 |
| DE | 19923421 A | 11/2000 |
| DE | 19928906 A | 1/2001 |

* cited by examiner

*Primary Examiner*—Mahmoud Gimie
(74) *Attorney, Agent, or Firm*—Ronald E. Greigg

(57) ABSTRACT

The invention relates to a 3/2-port directional-control valve for controlling the injection of fuel in a common rail injection system of an internal combustion engine, with a first switched position in which an injection nozzle is connected to a fuel return and with a second switched position in which the injection nozzle is connected to a high-pressure fuel reservoir. The beginning of the injection takes place in a pressure-controlled manner, whereas the end of the injection takes place in a stroke-controlled manner.

18 Claims, 3 Drawing Sheets

3/2 DIRECTIONAL-CONTROL VALVE

CROSS-REFERENCE TO RELATED APPLICATIONS

This application is a 35 USC 371 application of PCT/DE 02/00186 filed on Jan. 22, 2002.

BACKGROUND OF THE INVENTION

1. Field of the Invention

The invention relates to a 3/2-port directional-control valve for controlling the injection of fuel in a common rail injection system of an internal combustion engine, with a first switched position in which an injection nozzle is connected to a fuel return and with a second switched position in which the injection nozzle is connected to a high-pressure fuel reservoir.

2. Description of the Prior Art

A 3/2-port directional-control valve of the type with which this invention is concerned is known, for example, from DE 197 24 637 A1. In common rail injection systems, a high-pressure pump supplies the fuel into the central high-pressure reservoir, which is referred to as the common rail. High-pressure lines lead from the rail to the individual injectors, which are associated with the cylinders of the engine. The injectors are individually triggered by the engine electronics. When the control valve opens, highly pressurized fuel travels past the nozzle needle, which has been lifted up counter to the prestressing force of a nozzle spring, and into the combustion chamber.

OBJECTS AND SUMMARY OF THE INVENTION

The object of the invention is to improve the function and quality of the injection. Moreover, the control valve according to the invention should be simply designed and inexpensive to produce.

In a 3/2-port directional-control valve for controlling the injection of fuel in a common rail injection system of an internal combustion engine, with a control piston that is guided in a housing in which, in a first switched position, the control piston unblocks a hydraulic connection between an injector and a fuel return and in a second switched position, the control piston unblocks a hydraulic connection between the injector and a high-pressure fuel reservoir, the object is attained by virtue of the fact that during the transition from the second switched position into the first switched position, the movement of the control piston is transmitted to the nozzle needle of the injector.

The stroke control of the nozzle needle during the closing phase of the control piston prevents pressure oscillations between the metering valve and the nozzle from causing the nozzle needle to close in a delayed fashion or causing the injector to reopen. This delayed closing of the needle or reopening of the injector increases the fuel consumption of the internal combustion engine and worsens emissions levels. In addition, the 3/2-port directional-control valve according to the invention can be fully adjusted and assembled as a unit and then installed in an injector, an injection nozzle, a nozzle holder combination, or a unit fuel injector. Furthermore, the 3/2-port directional-control valve according to the invention can be used with different injectors matched to the engine, without structural changes to the metering valve.

The combination of the 3/2-port directional-control valve and injector is simplified according to the invention in that the control piston and the nozzle needle of the injector are associated coaxially with each other.

One variant of the invention includes a provision that a plunger rod be disposed between the control piston and the nozzle needle so that the injector and metering valve can be assembled as independently produced units and the control piston and nozzle needle are coupled by means of the plunger rod.

It can be advantageous if there is play in the axial direction between the control piston and the plunger rod in the first switched position so that thermal expansions and manufacturing tolerances alike have no negative effects on the function of the injection system.

In variants of the invention, the control piston is comprised of two parts so that a complete force balancing of the control piston can be achieved and at the same time, the manufacture and assembly of the 3/2-port directional-control valve according to the invention can be simplified.

Depending on the manufacturing profile, the 3/2-port directional-control valve can be embodied as a seat/seat valve or as a seat/slider valve.

The 3/2-port directional-control valve according to the invention can be actuated by a solenoid valve or a piezoelectric actuator so that the valve according to the invention can be used for an extremely wide variety of designs and requirements with regard to closing speed, closing force, etc.

In principle, the 3/2-port directional-control valves according to the invention can be comprised of one part or two parts. They can be controlled by a solenoid valve or a piezoelectric actuator, directly or by means of a servo circuit.

BRIEF DESCRIPTION OF THE DRAWINGS

Other advantages, features, and details of the invention ensue from the following description, with reference drawings, in which.

DESCRIPTION OF THE PREFERRED EMBODIMENTS

Figure 1:
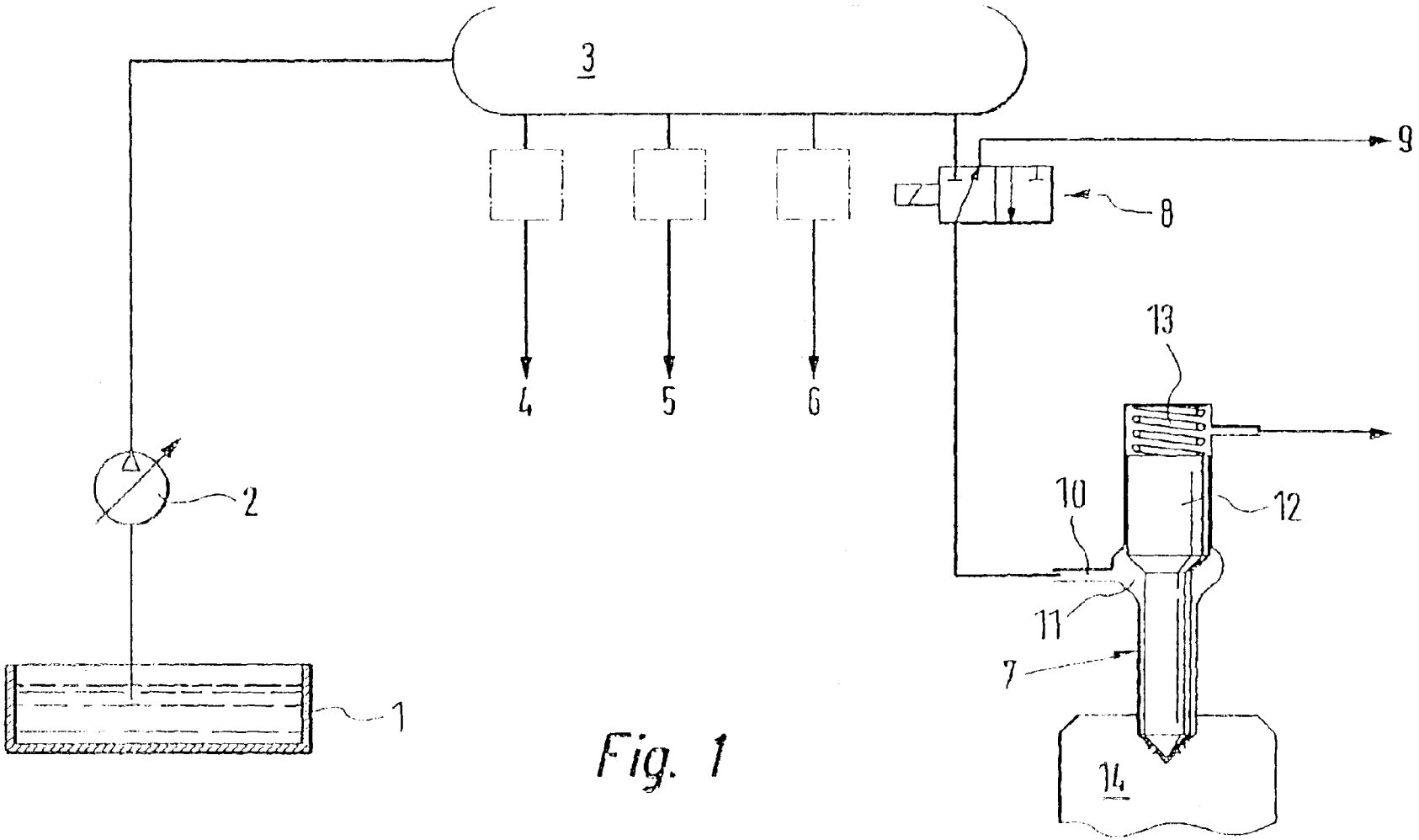
FIG. 1 schematically depicts a common rail injection system.

FIG. 1 schematically depicts a common rail injection system. A pump unit 2 supplies fuel from a fuel tank 1 into a high-pressure fuel reservoir 3, where the fuel is subjected to high pressure. The highly pressurized fuel is then metered as needed into the individual cylinders of the internal combustion engine to be supplied. Injectors 4, 5, 6, and 7 inject the highly pressurized fuel. In connection with the invention, the term injector is understood to mean any kind of injection nozzle or nozzle holder combination.

For the sake of clarity, only the injector 7 is shown in FIG. 1. A metering valve 8, which is embodied as a 3/2-port directional-control valve, supplies fuel to the injector 7. In the exemplary embodiments of the invention described below, the metering valve 8 is disposed directly on the injector 7.

The metering valve 8 is a 3/2-port directional-control valve, which is electromagnetically actuated. In the switched position shown in FIG. 1, the connection between the high-pressure fuel reservoir 3 and a high-pressure connection 10 of the injector 7 is closed. The high-pressure connection 10 of the injector 7 is connected to a fuel return 9 in the switched position of the metering valve 8 shown in FIG. 1.

When the metering valve 8 is actuated, it is switched into the second switched position, which is not shown in FIG. 1. In the second switched position, the high-pressure connection 10 of the injector 7 communicates directly with the high-pressure fuel reservoir 3. In this switched position, highly pressurized fuel travels from the high-pressure fuel reservoir 3, through the high-pressure connection 10, into a pressure chamber 11 contained in the injector 7. When the pressure in the pressure chamber 11 exceeds a particular value, a nozzle needle 12, which lists up from its seat counter to the prestressing force of a nozzle spring 13, and highly pressurized fuel is injected into the combustion chamber 14 of the internal combustion engine to be supplied. The common rail system shown in FIG. 1 is pressure-controlled; this means that fuel is only present in the injector 7 when fuel is supposed to be injected into the combustion chamber.

Figure 2:
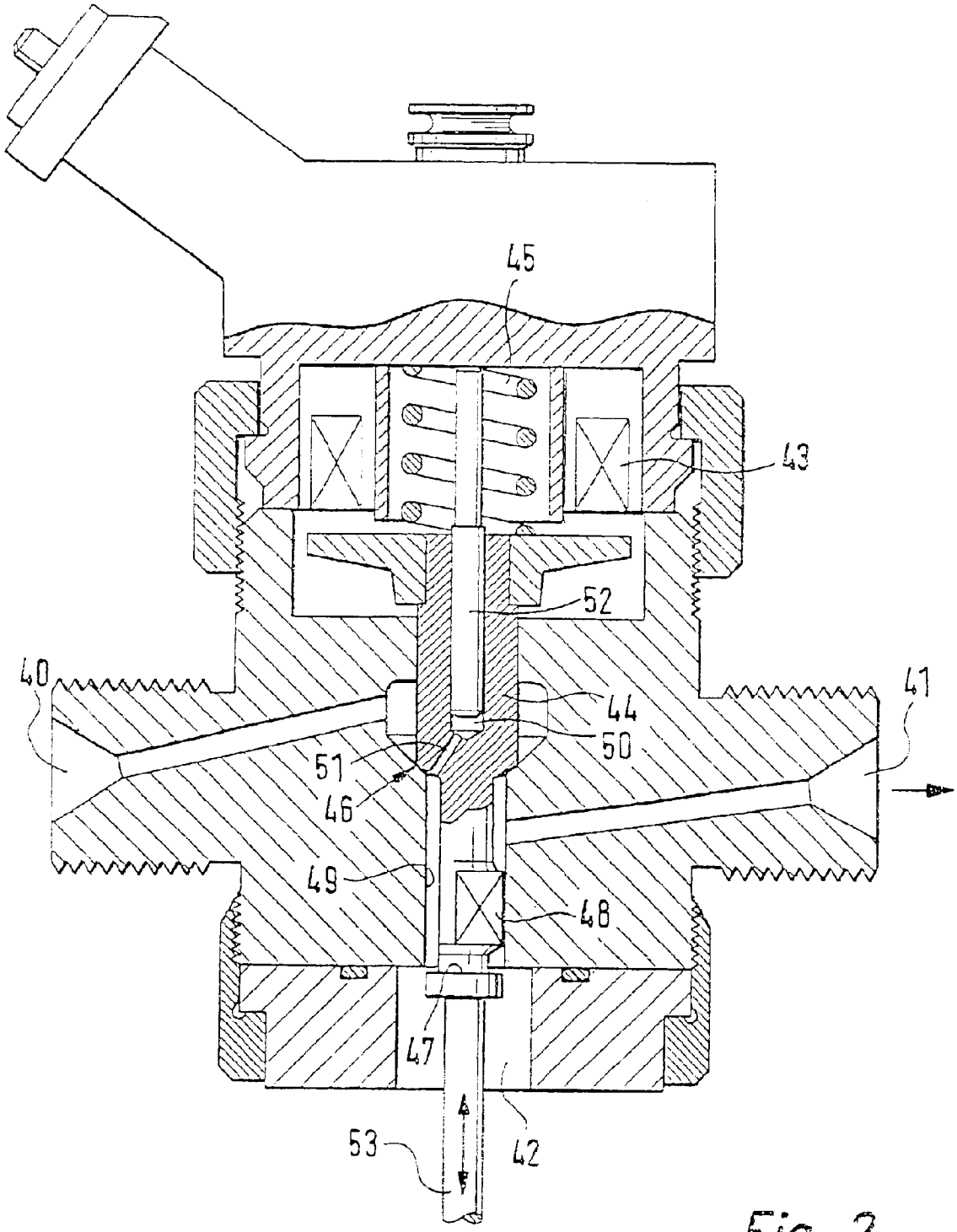
FIG. 2 shows a longitudinal section through a first embodiment of a 3/2-port directional-control valve according to the invention, which is directly control by a solenoid valve.

FIG. 2 shows a metering valve 8 embodied as a seat/slider valve with a control piston 44. The movement of the control piston 44 is controlled directly by means of an electromagnet 43. Direct control of the movement of the control piston 44, however, is only feasible if the required magnetic forces can be kept within certain limits. To this end, the control piston 44 must be pressure-balanced as completely as possible in the opening and closing phase.

In the switched position of the metering valve 8 shown in FIG. 2, a connection between a fuel inlet 40 and a connection 41 for the injector 7 (not shown) is closed. At the same time, a connection between the connection 41 and a fuel return 42 is open. In the switched position shown in FIG. 2, the control piston 44 is pressed against its valve seat 46 with the aid of a compression spring 45. In this position, the pressure in the injector can be reduced by means of the connection 41, which communicates with a fuel return 42. A central blind bore 50 is let into the end of the control piston 44 oriented toward the compression spring 45. By means of a bore 51, the blind bore 50 communicates with a longitudinal bore 49 that contains the control piston 44 so that it can move back and forth. The blind bore 50 contains a piston 52 so that it can move back and forth. The piston 52 is supported against the valve housing. A desired throttling action, which produces a time delay in the pressure balancing, can be set by means of the diameter of the bore 51.

The control piston 44 has two guides. On the one hand, the control piston 44 is guided above the fuel inlet 40 and on the other, it is guided in the valve housing by means of a polygonal guide 48. Since the diameter of the valve seat 46 corresponds to the upper diameter of the control piston 44, the control piston 44 is completely pressure-balanced during the opening.

When the solenoid valve is supplied with current in order to lift up the control piston 44, only the forces of the compression spring 45 have to be overcome. When the control piston 44 is lifted up, the valve seat 46 opens and a control edge 47 closes the longitudinal bore 49. As a result, the highly pressurized fuel travels into the valve by means of the fuel inlet 40. A pressure wave travels at the speed of sound through the connection 41 to the injector 7, and the injection begins.

After the opening, the control piston 44 is at first no longer pressure-balanced. Additional hydraulic forces act in the opening direction, which impinge on the resulting annular area between the control edge 47 and the upper guide of the control piston 44. These forces must be balanced since they act in opposition to the compression spring 45 and prevent the control piston 44 from closing. The blind bore 50 makes it possible for the pressure balancing to occur. The bore 51 assures that the hydraulic pressure prevails in the blind bore 50 and generates forces in the closing direction of the control piston 44. These forces depend on the diameter of the blind bore 50, from which the area of the connecting bore 51 must be subtracted. If the pressure area in the blind bore 50 is the same size as the annular area between the control edge 47 and the upper guide of the control piston 44, then the control piston 40 completely pressure-balanced. However, the diameter of the blind bore 50 can also be greater than the pressure area on the control piston 44. This can generate additional forces that permit an accelerated closing. The additional closing forces, however, should remain low enough that the force equilibrium is not shifted excessively.

The piston 52 guided in the blind bore 50 prevents pressurized fuel from permanently flowing out of the compensation chamber into the overflow return. The space in the blind bore 50 unoccupied by the piston 52 is referred to as the compensation chamber. The volume of the compensation chamber is decisive in determining the point at which pressure balance is achieved after the opening of the valve seat 46. With a large volume, the influx and the pressure buildup take a longer amount of time. Since as a rule small preinjection quantities must be produced and the valve should close again after the preinjection, the volume must be kept as low as possible.

Underneath the control piston 44, a plunger rod 53 is provided, which rests with one end against an end face of the control piston 44 and with its other end, acts on the nozzle needle, not shown, of an injector 7, also not shown in FIG. 2. The plunger rod 53 and the nozzle needle can also be embodied of one piece with each other.

The pressure-controlled opening of the nozzle needle, not shown, causes the plunger rod 53 to move upward. If the control piston stroke and the nozzle needle stroke are the same, then the control piston 44 and the nozzle needle are decoupled since the movement of the control piston 44 takes place prior to the movement of the nozzle needle. Only after the control piston 44 is moved downward at the end of the injection process in FIG. 2 is this downward motion transmitted by the plunger rod 53 onto the nozzle needle so that the nozzle needle also moves toward its seat. As soon as the control edge 47 unblocks the fuel return 42, the pressure relief of the injector by means of the connection 41 begins.

As a result, the injector 7 is closed in a stroke-controlled manner and pressure oscillations between the metering valve and the injection nozzle are prevented from causing a delayed closing of the needle or even a reopening of the nozzle needle. Even if the pressure relief of the injector 7 does not occur rapidly enough, the stroke-controlled closing of the nozzle needle prevents the danger of dribbles. For technical manufacturing reasons, a small gap can remain between the plunger rod 53 and the control piston 44 when the control piston 44 and the nozzle needle are in their seat. This gap does not impair the dynamics of the closing process or of the function.

Figure 3:
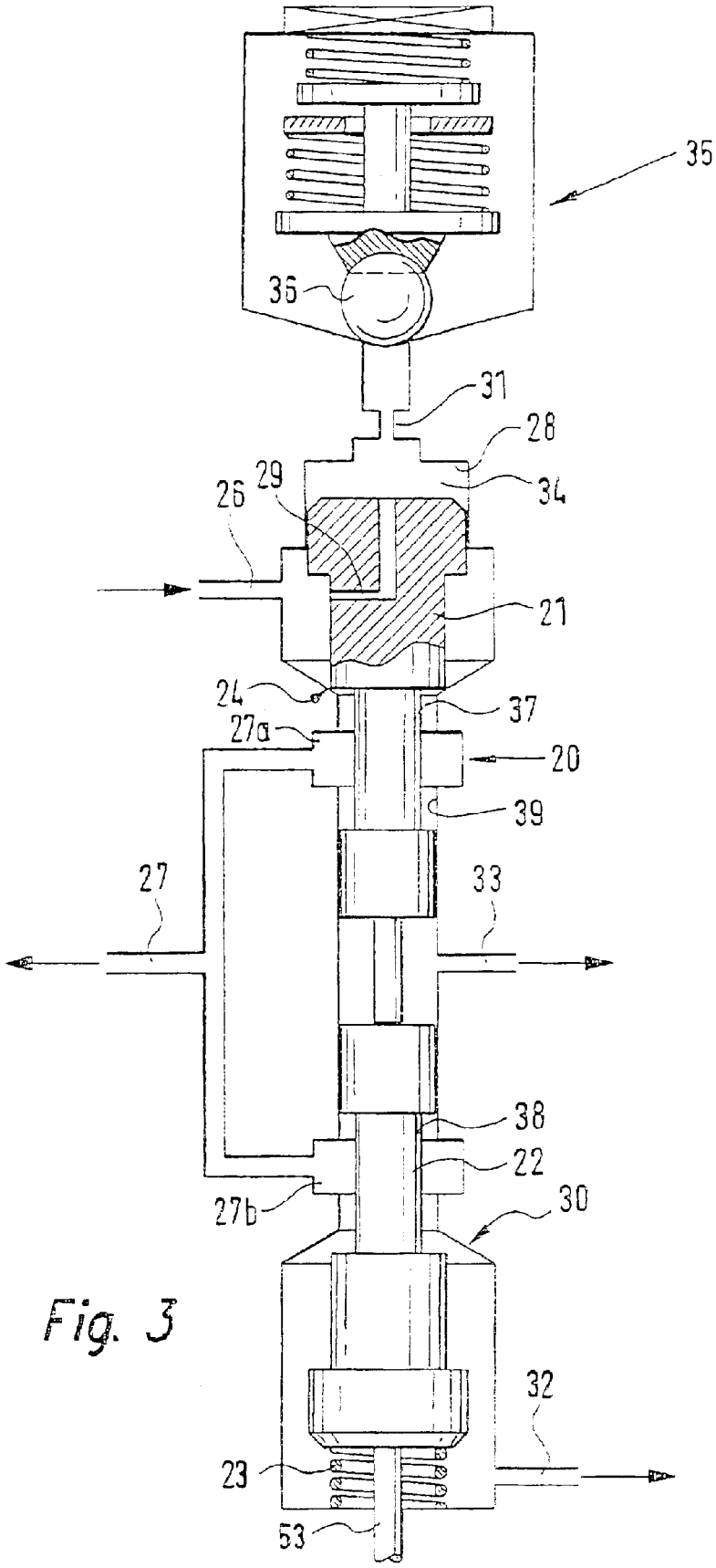
FIG. 3 shows a second embodiment of a 3/2-port directional-control valve according to the invention, in the first switched position.

FIG. 3 shows a second exemplary embodiment of a 3/2-port directional-control valve according to the invention, embodied as a seat/seat valve. The metering valve shown in a longitudinal section in FIG. 3 includes a valve housing 20, which contains a first control piston 21 and a second control piston 22 so that they can move back and forth in a guide bore 39. The control piston 22 is force-balanced through the structural design of its pressure surfaces. The control piston 22 is embodied as a servo-hydraulic valve. The force balancing of the first control piston 21 is achieved by means of a first constriction 37 in the first control piston 21 in the region 27*a* of the connection 27. The force balancing of the second control piston 22 is achieved by means of a second constriction 38 in the second control piston 22 in the region 27b of the connection 27. This means that extremely small forces are sufficient to move the corresponding control piston.

The second control piston 22 is prestressed by means of a compression spring 23. In the switched position shown in FIG. 2, the first control piston 21 rests against the end of the second control piston 22 oriented away from the compression spring 23. A first valve seat 24, which is shown in the closed position in FIG. 3, is formed between the first control piston 21 and the valve housing 20.

In the first switched position shown in FIG. 3, a communication is closed between the fuel inlet 26, which is in turn connected to a common rail that is not shown, and a connection 27 to an injector that is not shown.

A second valve seat 30, which is formed between the second control piston 22 and the valve housing 20, is shown in the open position in FIG. 3. As a result, a communication is opened between the connection 27 for the injection nozzle and a first fuel return 32. A second fuel return 33 serves to return the overflow that occurs during operation. In this first switched position, the injector is not pressurized.

The movement of the two control pistons 21 and 22 is controlled with the aid of a solenoid valve 35 by means of the pressure in a control chamber 34. In the first switched position shown in FIG. 3, a valve ball 36 prevents a pressure relief of the control chamber 34. Highly pressurized fuel travels into the control chamber 34 by means of an inlet throttle 29 embodied in the first control piston 21. The highly pressurized fuel in the control chamber 34 assures that the first control piston 21 is pushed downward against the second control piston 22. As a result, the first valve seat 24 is kept closed. At the same time, the second control piston 22 is pressed against the compression spring 23.

When the solenoid valve 35 opens and the valve ball 36 lifts up from its associated seat, the pressure in the control chamber 34 decreases and the first control piston 21 moves upward until it reaches a stop 28. The speed of the movement of the first control piston 21 can be set through the design of the surfaces on the first control piston 21 that are subjected to pressure and through the matching of an inlet throttle 29 and an outlet throttle 31. At the same time, the second control piston 22 is likewise move upward by the initial stress of the compression spring 23 so that the second valve seat 30 is closed.

All of the valve surfaces that communicate directly with the connection 27 are designed so that they cannot exert any force on the control pistons 21 and 22. The forces acting on the control pistons 21 and 22 are either exerted by the compression spring 23 or are hydraulic forces that have no force jumps or other irregularities during the movement phase of the first control piston 21 and of the second control piston 22.

As soon as the first and second control pistons in FIG. 3 have move upward, a nozzle needle, not shown, which belongs to the injector and is disposed underneath the plunger rod 53, is opened in a pressure-controlled manner. As a result, the plunger rod 53 in FIG. 3 moves upward.

As soon as the solenoid valve 35 closes, the first and second control pistons 21 and 22 in FIG. 3 move downward and, by means of the plunger rod 53, execute a stroke-controlled closing of the nozzle needle, not shown. As a result, the advantages of the pressure-controlled opening and the stroke-controlled closing of the injector are combined with one another in a simple manner.

The foregoing relates to preferred exemplary embodiments of the invention, it being understood that other variants and embodiments thereof are possible within the spirit and scope of the invention, the latter being defined by the appended claims.

What is claimed is:

1. A 3/2-port directional-control valve for controlling the injection of fuel in a common rail injection system of an internal combustion engine, the valve comprising a control piston (44, 21, 22) guided in a housing (20), in which in a first switched position, the control piston (44, 21, 22) opens a hydraulic connection between an injector (7), having a nozzle needle (12), and a fuel return (42, 32) and in which in a second switched position, the control piston (44, 21, 22) opens a hydraulic connection between the injector (7) and a high-pressure fuel reservoir (3), a pluger rod (53) disposed between the control piston (44, 21, 22) and the nozzle needle (12) of the injector, the plunger rod resting with one end against an end face of the control piston and with its other end acting on the nozzle needle, the movement of the control piston (44, 21, 22) is transmitted to the nozzle needle (12) of the injector (7) during the transition from the second switched position into the first switched position.

2. The 3/2-port directional-control valve according to claim 1 wherein the control piston (44, 21, 22) and the nozzle needle (12) are disposed coaxial to each other.

3. The 3/2-port directional-control valve according to claim 1 wherein there is play in the axial direction between the control piston (44, 21, 22) and the plunger rod (53) in the first switched position.

4. The 3/2-port directional-control valve according to claim 2 wherein there is play in the axial direction between the control piston (44, 21, 22) and the plunger rod (53) in the first switched position.

5. The 3/2-port directional-control valve according to claim 1 wherein the control piston (44) is comprised of one part.

6. The 3/2-port directional-control valve according to claim 2 wherein the control piston (44) is comprised of one part.

7. The 3/2-port directional-control valve according to claim 3 wherein the control piston (44) is comprised of one part.

8. The 3/2-port directional-control valve according to claim 1 the control piston (44) is comprised of two parts.

9. The 3/2-port directional-control valve according to claim 2 the control piston (44) is comprised of two parts.

10. The 3/2-port directional-control valve according to claim 3 the control piston (44) is comprised of two parts.

11. The 3/2-port directional-control valve according to claim 1 wherein the 3/2-port directional-control valve (8) is embodied as a seat/seat valve.

12. The 3/2-port directional-control valve according to claim 2 wherein the 3/2-port directional-control valve (8) is embodied as a seat/seat valve.

13. The 3/2-port directional-control valve according to claim 3 wherein the 3/2-port directional-control valve (8) is embodied as a seat/seat valve.

14. The 3/2-port directional-control valve according to claim 1 wherein the 3/2-port directional-control valve (8) is embodied as a seat/slider valve.

15. The 3/2-port directional-control valve according to claim 3 wherein the 3/2-port directional-control valve (8) is embodied as a seat/slider valve.

16. The 3/2-port directional-control valve according to claim 1 wherein the control piston (44, 21, 22) is actuated by means of a solenoid valve (35) or a piezoelectric actuator.

17. The 3/2-port directional-control valve according to claim 8 wherein the control piston (44, 21, 22) is actuated by means of a solenoid valve (35) or a piezoelectric actuator.

18. The 3/2-port directional-control valve according to claim 1 used with an injector (7), an injection nozzle, a nozzle holder combination, or a unit fuel injector.

* * * * *